US006988963B2

(12) United States Patent
Lubosco et al.

(10) Patent No.: US 6,988,963 B2
(45) **Date of Patent: *Jan. 24, 2006**

(54) VERSATILE PRACTICE INSERTION TIP GOLF TEE ANCHOR

(76) Inventors: Ronald Lubosco, 10225 Thayer St., Brooksville, FL (US) 34601; Ralph Joesph Lubosco, 134 Arnold Blvd., High Bar Harbor, NJ (US) 08008

( * ) Notice: Subject to any disclaimer, the term of this patent is extended or adjusted under 35 U.S.C. 154(b) by 21 days.

This patent is subject to a terminal disclaimer.

(21) Appl. No.: 10/700,766

(22) Filed: Nov. 4, 2003

(65) Prior Publication Data

US 2004/0092339 A1 May 13, 2004

Related U.S. Application Data

(60) Provisional application No. 60/423,422, filed on Nov. 4, 2002.

(51) Int. Cl.
*A63B 69/36* (2006.01)

(52) U.S. Cl. ..... 473/387

(58) Field of Classification Search ..... 473/387–403, 473/417–420, 280, 281, 138, 139
See application file for complete search history.

(56) References Cited

U.S. PATENT DOCUMENTS 1,921,523 A * 8/1933 Hart ..... 473/281
1,936,625 A * 11/1933 Goldman ..... 473/398
1,979,795 A * 11/1934 Clark ..... 473/139
3,099,452 A * 7/1963 Fernicola ..... 473/280
3,858,878 A * 1/1975 Tassone ..... 473/417
4,531,734 A * 7/1985 Herrick ..... 473/429
4,786,054 A * 11/1988 Keys ..... 473/268
4,989,867 A * 2/1991 Herrick ..... 473/429
5,492,323 A * 2/1996 Lee ..... 473/278
6,682,445 B1 * 1/2004 Tanner ..... 473/417

* cited by examiner

*Primary Examiner*—Steven Wong

(57) ABSTRACT

A practice/playing golf tee that is substantially indestructible. It includes a screw up/down golf tee head. When the head is screwed down the insertion tip parameter of the tee can be used. The insertion tip at the top of the tee goes into one of the existing holes in a practice golf ball or a regulation golf ball in which hole (s) are incorporated to accomadate the insertion tip. When the insertion tip is used with a wiffle type practice ball there is no spin resistance and a true flight path exists. A perfect grass lie can always be obtained. When the insertion tip is used with the much heavier regulation golf ball into which an insertion hole is incorporated, a spin resistance exists. This spin resistance can be adjusted by screwing the tee head up or down the top of the tee shaft. The spin resistance can stop a hook or slice. As the amateur golfer becomes more adept he/she can decrease the spin resistance by screwing the tee head up toward the top of the tee shaft. When the tee head is screwed up flush with the top of the tee shaft a regulation ball can be hit. In all uses of the tee a perfect grass lie can easily be obtained. Because of the anchoring variation parameter of the tee, the tee can be used for a continuous, convenient practice, or in playing the game of golf.

2 Claims, 4 Drawing Sheets

VERSATILE PRACTICE INSERTION TIP GOLF TEE ANCHOR

CROSS REFERENCE TO RELATED APPLICATIONS

This applicant claims the benefit of U.S. Provisional Application No. 60/423,422, filed Nov. 4, 2002.

STATEMENT REGARDING FEDERALLY SPONSORED RESEACH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention has a screw up/down tee head. The tee head screws up or down on the tee shaft. The difference in hardness characteristics between the tee head and the tee shaft make this possible. By screwing the tee head down, an insertion tip (the top of the tee shaft) is revealed. This insertion tip allows for the teeing up of wiffle type practice golf balls, because the upper tip of the tee shaft inserts into one of the holes in the wiffle golf ball. To accommodate conventional golf balls a hole must be incorporated into the golf ball. By screwing the tee head up flush with the top of the tee shaft, the tee can accomadate a conventional golf ball (no holes incorporated).

The tee shaft is flexible and can be fit with a screw on/off tee anchor. The flexibility of the tee shaft itself increases the anchoring of the tee greatly even without the tee anchor attached.

Because the tee is extremely flexible and durable and can be anchored into the ground via the bottom anchor or flexible tee shaft all portability, practice and playing needs are addressed. The invention is made to tee up all types of practice or playing, golf balls. The invention has three basic parameters as follows: 1) an insertion tee tip parameter which allows the tee shaft to be inserted into the golf ball. 2) A conventional tee tip parameter that allows the golf ball to rest on top of the tee, which is the norm. 3) A flexible tee shaft that can be made in various lengths, with a conventionally pointed bottom tip that can be used to anchor the tee in a conventional sense or that can be screwed onto or off of a variety of larger bottom anchors. This parameter allows the golfer to vary the anchoring systems of the tee. Thus giving the golfer the choice of stability and portability, in reference to his or her golfing needs, also pertaining to surroundings, soil and environmental conditions.

Note: because of the screw up/down tee head, the invention allows the teeing up of all types of golf balls (practice or playing). Particularly when used when used with a conventional golf ball into which an insertion hole is incorporated. The resistance factor of the insertion tip in the golf bal can be decreased or increased by lowering or elevating respectively the screw up/down tee head. By increasing the resistance, the golf ball will be less likely to hook or slice. Thus allowing the less experienced golfer to drive the ball in a straight trajectory. As the golfers swing improves resistance can be taken off the golf bal by raising the tee head. The present invention is made to tee up all types of practice or playing golf balls. The uniqueness of the invention is that it has a screw up/down tee head that allows the protrusion of an upper insertion tip that inserts into one of the existing holes in the practice/playing golf ball. The properties of the tee eliminate the need for tee replacement or tee resets between practice swings. Because the tee is inserted into the practice golf ball, a perfect lie can always be accomplished very easily, despite environmental conditions. This especially pertains to the lightweight wiffle type golf ball, which can easily be disturbed from its lie by wind or gravity. The tee allows for an easy, enjoyable productive practice or playing session that is easy on the golfers back and nerves.

U.S. Pat. No. 6,053,822 to Kolodney discloses the problems of a perfect lie, but does not solve the problem of having to reset the tee and environmental conditions that would affect the lie of a plastic light weight wiffle golf ball.

Conventional tees must be replace or reset every time a golf ball is hit, as is also the case with the typical wiffle type practice golf ball. Also the wiffle practice golf ball has very little mass, making it very difficult for the golfer to tee up the practice ball on a conventional tee. Considering the environmental factors such as the wind and grass a good practice lie is very difficult and tedious to accomplish.

U.S. Pat. No. 5,413,348 to Basso discloses a golf anchoring system and a flexible upper tee member for continuous use, but it does not solve the problem of a lightweight practice golf ball falling off the tee due to environmental conditions.

BRIEF SUMMARY OF THE INVENTION

The present invention is made to tee up a wiffle type practice golf ball, or a solid type practice golf ball into which holes are incorporated. The uniqueness of the invention is that it has an upper insertion tip that inserts into one of the existing holes in the practice golf ball. The tee is extremely flexible, durable, and can be anchored into the ground via it bottom anchor. The properties of the tee eliminate the need for tee replacement or tee resets between practice swings. Because the tee is inserted into the practice golf ball, a perfect lie can always be accomplished very easily, despite environmental conditions. This especially pertains to the lightweight wiffle type ball, which can easily be disturbed from its lie by wind or gravity. The tee allows for an easy, enjoyable productive practice session that is easy on the golfers back and nerves.

BRIEF DESCRIPTION OF THE SEVERAL VIEWS OF THE DRAWING

FIG. 3A Top view of the preferred embodiment of the invention. Referring to the insertion tip, tee shaft, screw up/down tee head or (combination golf ball rest/conventional tee head) and the tee anchor.

DETAILED DESCRIPTION OF THE INVENTION

Figure 1A:
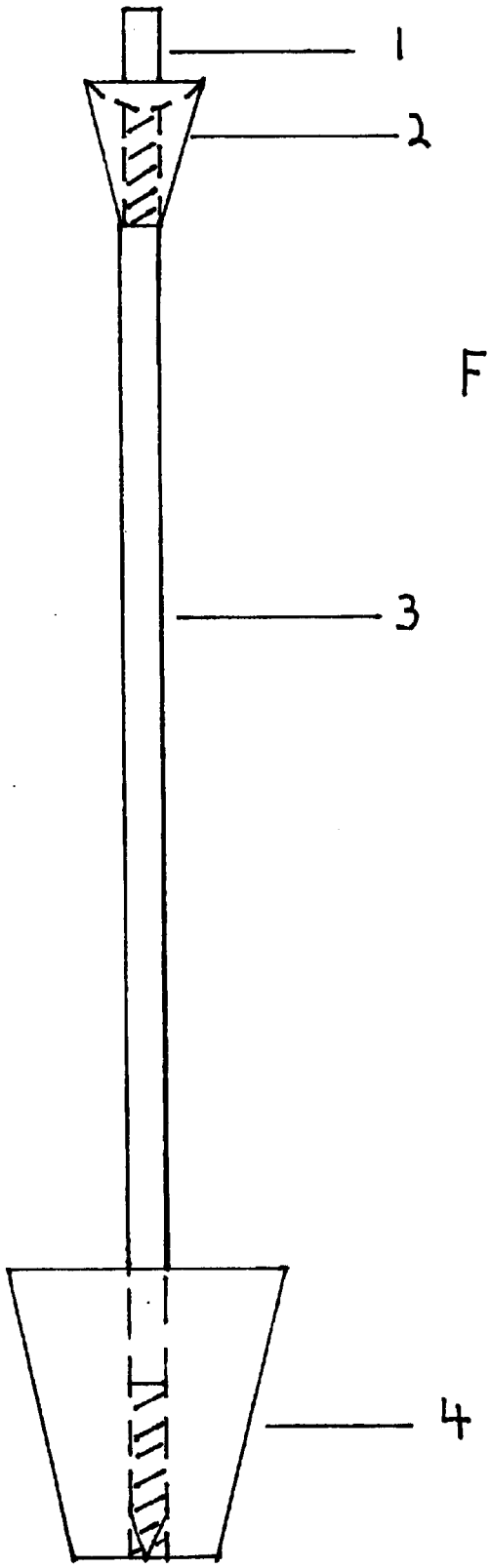
FIG. 1A Front view of the preferred embodiment of the invention. Referring to an insertion tip and screw up/down tee head or (combination golf ball rest/conventional tee head). Also referring to a pointed bottom tee shaft with a screw on or off tee anchor.

FIG. 1A; Illustrates the following numbered parts of the preferred embodiment of the invention: 1; Insertion tip, is the upper tip of the tee that is inserted into the hole of the practice golf ball dimensions are approximately ⅛ inch diameter by ¼ inch length (length can vary according to the adjustment of the tee head. 2; Preferred embodiment of the screw up/down tee head or (combination golf ball rest/conventional tee head), located just below the insertion tip, it stops the insertion tip from going into the golf ball too deeply and acts as a conventional tee head when screwed up flush with the top of the tee shaft. The dimensions of the screw up/down tee head are approximately ½ inch in length, 7⁄16 of an inch in diameter across the concave top of the tee head, and ¼–3⁄16 inch in diameter at the bottom of the tee head. The tee head has a cylindrical bore of approximately ⅛ inch with inside threads. 3; Preferred embodiment of the Tee shaft, the flexible shaft located between the screw up/down tee head and the bottom of the tee. The tee shaft is pointed at its bottom end. Dimensions are approximately ⅛ inch in diameter by 6¼ inches in length. The tee shaft length can be varied by the golfer using a utility knife. 4; The preferred embodiment of the Tee Anchor, located at the bottom of the tee, it anchors the tee into the ground. It has ⅛-inch diameter inside threads and is approximately ½ inches up from the bottom of the anchor. This feature accommodates the bottom of the pointed tee shaft and can be screwed on or off of the bottom of the tee shaft. Dimensions are 1-inch diameter at the top, ½ inch at the bottom by 1 inch in height. It is conically shaped and is hollowed, comparable to an electric screw cap.

Figure 2A:
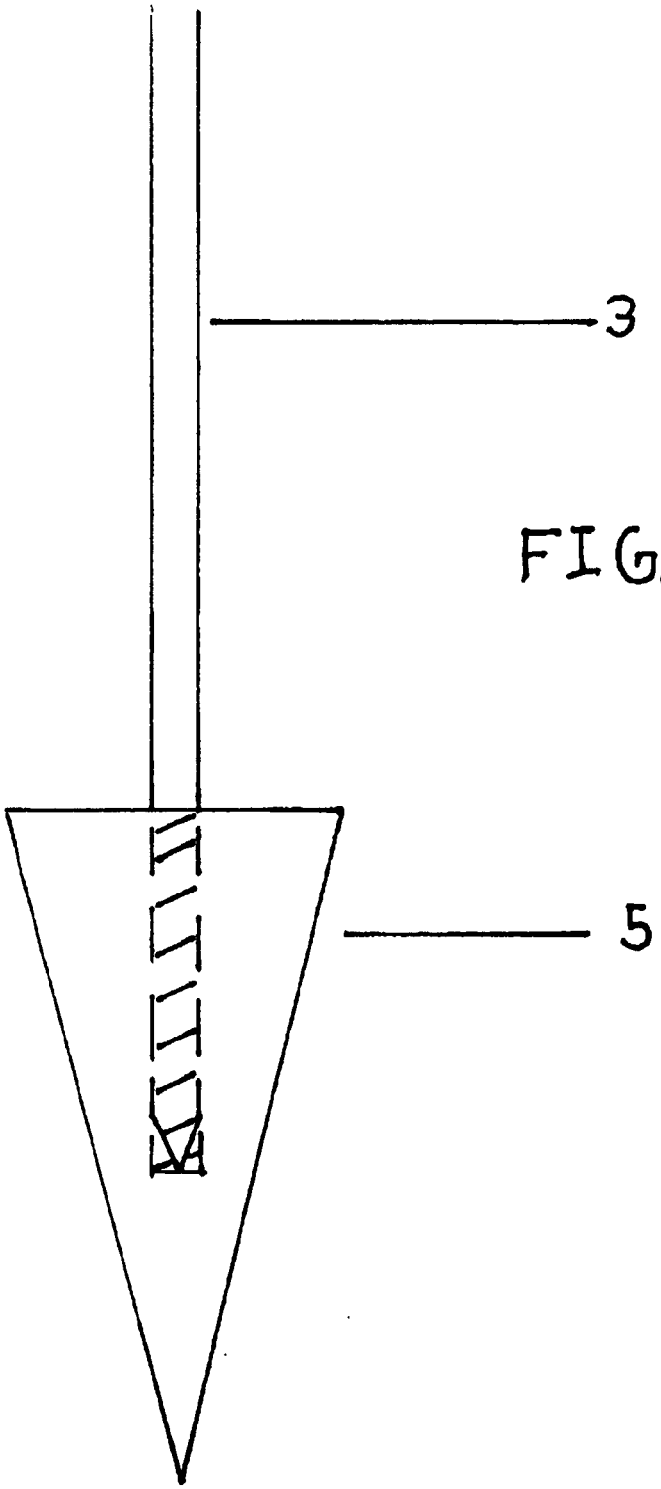
FIG. 2A Front view of the alternative embodiment of the invention. Referring to the golf tee anchor.

FIG. 2; Front view of the alternative embodiment of the invention. 5; Referring to the golf tee anchor.

Figure 3A:
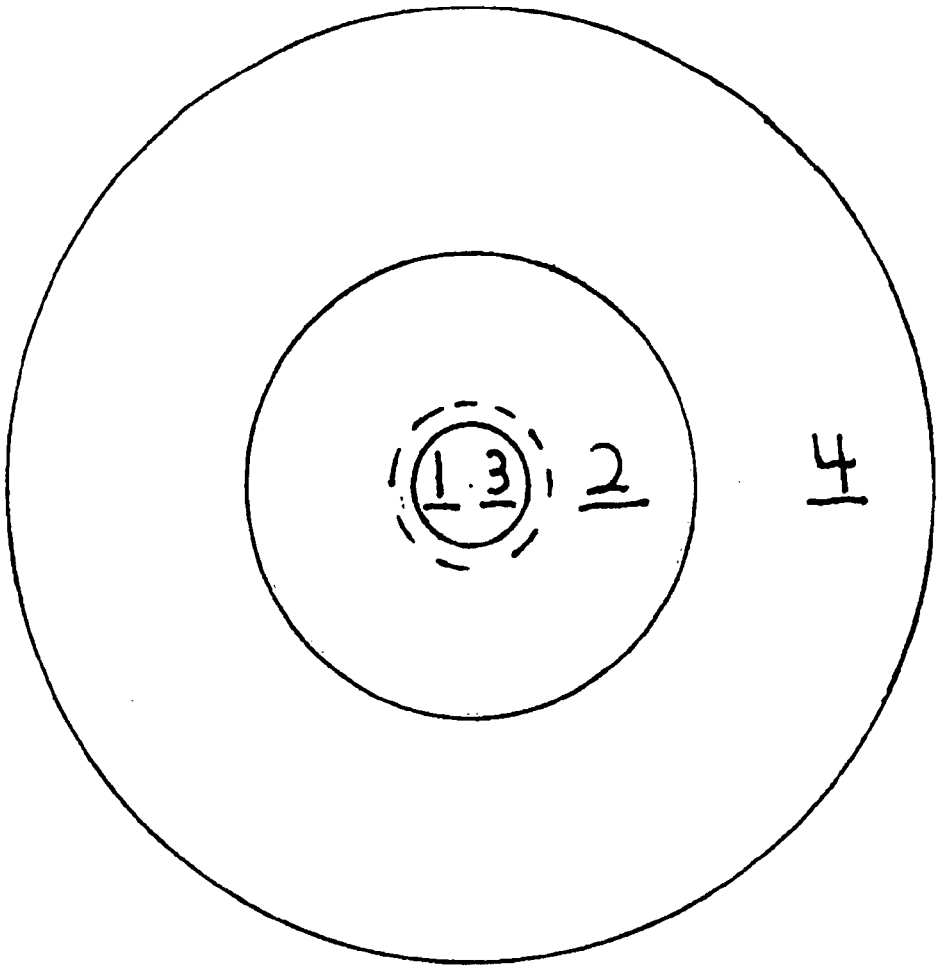

Dimensions are approximately 1 inch in diameter at the top by 1 inch in height, and is cone shaped with a pointed bottom. It has inside threads that have an approximate ⅛-inch diameter. FIG. 3A: Top view of the preferred embodiment of the invention. Illustrates the following numbered parts of the preferred embodiment of the invention: 1; Insertion tip, is the upper tip of the tee that is inserted into the hole of the practice golf ball dimensions are approximately ⅛ inch diameter by ¼ inch length (length can vary according to the adjustment of the tee head. 2; Preferred embodiment of the screw up/down tee head, located just below the insertion tip, it stops the insertion tip from going into the golf ball too deeply and acts as a conventional tee head when screwed up flush with the top of the tee shaft. The dimensions of the screw up/down tee head are approximately ½ inch in length, 7⁄16 of an inch in diameter across the concave top of the tee head, and ¼–3⁄16 inch in diameter at the bottom of the tee head. 3; Preferred embodiment of the Tee shaft, the flexible shaft located between the screw up/down tee head and the bottom of the tee. The tee shaft is pointed at its bottom end. Dimensions are approximately ⅛ inches in diameter by 6¼ inches in length. The tee shaft length can be varied by the golfer using a utility knife. 4; The preferred embodiment of the Tee Anchor, located at the bottom of the tee, it anchors the tee into the ground. It has ⅛-inch diameter inside threads and is approximately ½ inches up from the bottom of the anchor. This feature accommodates the bottom of the pointed tee shaft and can be screwed on or off of the bottom of the tee shaft. Dimensions are 1-inch diameter at the top, ½ inch at the bottom by 1 inch in height. It is conically shaped and is hollowed, comparable to an electric screw cap.

Figure 4A:
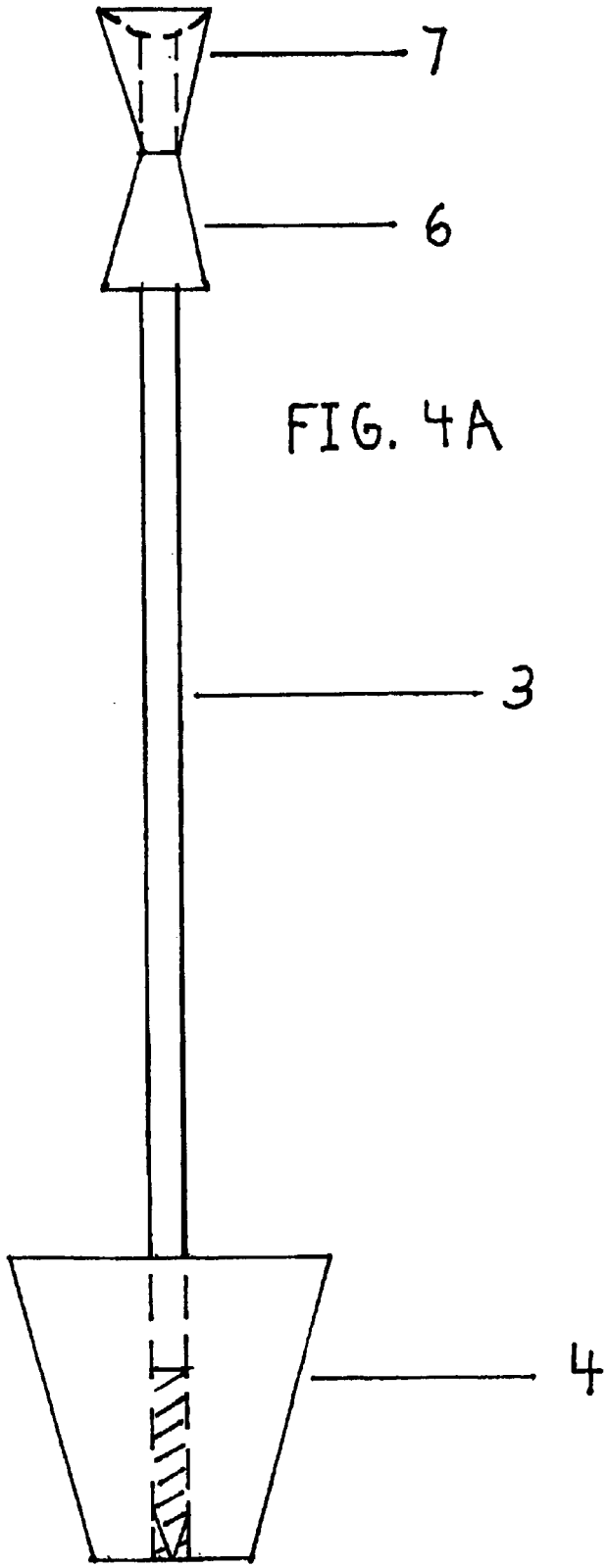
FIG. 4A Front view of the alternative embodiment of the invention. Referring to the tee shaft/golf ball rest, which are singly molded. Also referring to the screw on/off tee head or (screw on/off conventional tee head).

FIG. 4A: Front view of the alternative embodiment of the Golf Tee. 6: Singly molded Tee shaft/golf ball rest. The golf ball rest and upper tee shaft are the insertion tip of the tee. The tip of the upper tee shaft would be cone shaped (the pointed part of the cone being the insertion tip). Dimensions of the largest diameter of the cone are approximately ½ inch. The length of the cone is approximately ½ inch. 7; The screw on/off tee head with dimensions of approximately ½ inch in length, 7⁄16of an inch in diameter across the concave top of the tee head, and ¼–3⁄16 inch in diameter at the bottom of the tee head. The tee head has a partial cylindrical bore with an approximate ⅛ inch inside diameter and inside threads. The partial bore is approximately ¼ inch in length from the bottom of the tee head up. The screw on/off tee head is screwed onto the cone shaped insertion tip when the conventional tee parameter is to be used. 3; Tee shaft: 4: Tee anchor.

The present invention is named "THE PRACTICE VERSATILE INSERTION TIP GOLF TEE ANCHOR" and is referenced by U.S. Provisional Patent Application No. 60/386,806 and the U.S. Provisional Patent Application No. 60/423,422., and U.S. patent application Ser. No. 10/455,056. This invention is made to tee up a wiffle type practice golf balls, a solid type practice golf balls, and regulation golf balls.

Parameter 1:

In regard to the insertion tip parameter of the invention. If the invention is to be used with any type of non-holed golf ball, an insertion hole/holes must be incorporated into the golf ball. These holes must be drilled or molded to accommodate, in a loose fit manor, the insertion tip (FIG. 1A: 1) (FIG. 4A: 6) of the Versatile Practice Golf Tee Anchor such that minimal resistance would occur as the golf ball departed the tee upon impact from the golf club head. In this invention, when using the insertion tip parameter, the practice ball does not rest soley on top of the tee. Instead the tee with an approximate ⅛ inch diameter flexible shaft is inserted loosely into one of the existing approximate (¼, ⅜) inch diameter holes of the practice golf ball to a depth of approximately ¼-inch. The golf tee shaft increases to approximately 7⁄16 to ½-inch diameter immediately following the approximate ¼-inch length insertion of the tip of the golf tee. This increased diameter of the golf tee shaft acts as a rest for the outside surface of the practice ball and I will refer to it as the "golf ball rest". The "golf ball rest" (FIG. 1A: 2) (FIG. 4A: 6) is approximately ½-inch in length and can be flat, concave, convex or conical in relation to the outer surface of the practice golf ball. Note: the insertion tip can be greater than ¼ of an inch.

Preferably the "golf ball rest" (FIG. 1A: 2) may also be made via a single mold to simulate the head of a conventional tee. It would also be made in such a matter as to be able to be screwed up and down on the insertion tip (FIG. 1A: 1) on the tee shaft thus allowing the golf ball rest to be used with the conventional tee tip parameter and the insertion tip parameter. This type of golf ball rest will be referred to as the "combination golf ball rest/conventional tee head" or the screw up/down tee head (FIG. 1A: 2). The dimensions and shape of the "combination golf ball rest/conventional tee head" (FIG. 1A: 2) would be approximately ½-inch in length, 7⁄16 of an inch in diameter across the concave top of the tee head, and ¼–3⁄16 inch in diameter at the bottom of the "combination golf ball rest/conventional tee head" (FIG. 1A: 2) screw on golf ball rest. The molded "combination golf ball rest/conventional tee head" would have an approximate ⅛-inch cylindrical bore through its entire length with inside threads. It could be screwed up and down the upper tip of the tee shaft. It would allow the tee to be used as a conventional type tee head when screwed approximately flush with the top of the insertion tip and would also allow the tee to be used with the insertion tip parameter when screwed down on the tee tip approximately ¼ of an inch.

Thus allowing the golfer to go from a conventional type tee to an insertion tip (FIG. 1A: 1), type tee. Again this modified golf ball rest will be referred to as the "combination golf ball rest/conventional tee head" (FIG. 1A: 2).

Parameter 2:

The conventional tee tip parameter allows the golf ball to rest on top of the tee, which is the norm. As indicated above the "combination golf ball rest/conventional tee head" (FIG. 1A: 2) may also be made via a single mold to simulate the head of a conventional tee. The molded golf ball rest has an ⅛-inch cylindrical bore through its entirer length with inside threads. The "combination golf ball rest/conventional tee head (FIG. 1A: 2)" could be screwed up and down the upper tip of the tee shaft. Thus allowing the use of parameter 1 or parameter 2. The conventional tee tip parameter can also be realized by using a screw on type conventionally shaped tee head molded of a durable plastic with a partial cylindrical threaded bore (FIG. 4A: 7). The dimensions of the screw on tee head (FIG. 4A: 7) would be approximately the same as the fully threaded "combination golf ball rest/conventional tee head"(FIG. 1A: 2) referred to in parameter 1, above. In this case the bore in the tee head would be approximately halfway through the bottom length of tee head. This would allow the tee head to screw onto the upper tip of the tee shaft. Thus the tee head could be screwed on or off of the upper tip of the tee. In this case the "golf ball rest"(FIG. 4A: 6) for the insertion tip parameter would not be movable but fixed or singly molded to the upper tee shaft approximately ¼-inch from the top of the tee shaft. Only the tee head could be screwed on or off of the insertion tip of the tee. This parameter would allow for practice or playing of golf with non-holed golf balls in the conventional sense when screwing the tee head on. When unscrewing the tee head, thus taking the tee head, off the insertion tip parameter of the tee could be used. This screw on tee head will be referred to as the "screw on/off conventional tee head"(FIG. 4A: 7) or the "screw on/off tee head".

Parameter 3:

The entire golf tee can vary in length from approximately 6½ inches to the size of a conventional wood tee. The preferred length for maximum stability is approximately 6½ inches, while the preferred length for maximum portability is about the size of a conventional tee. Variations in length when making the tee allow for adaptations to accommodate surrounding such as the golfers back yard, the driving range or the golf course. Variations in tee shaft length (FIG. 4A: 7) also allow for soil and environmental conditions pertaining to inserting the tee in the ground, tee stability and tee portability. The durable, flexible tee shaft (FIG. 1A: 3) is anchored via the bottom of the tee. The anchor size can be varied to accommodate environmental conditions. The preferred anchor (FIG. 1A: 4) size for maximum stability is as follows: The anchor length from the bottom of the tee upwards is approximately one inch. The diameter at the top of the anchor is approximately one inch. The diameter at the bottom of the anchor is approximately ½ inch. The anchor is conically shaped and uniformly encircles the approximately ⅛ inch flexible shaft (FIG. 1A: 3), which is the vertical axis of the tee. The bottom of the tee shaft (FIG. 1A: 3) is pointed and is screwed into the anchor (FIG. 1A: 4) or can be singly molded by making different varieties of the tee. If the golfer desires the tee shaft can be unscrewed from the above anchor (FIG. 1A: 3) and the pointed end of the tee shaft can be used to anchor the tee into the ground. The tee anchor would then simulate a conventional golf tee anchoring system and would provide maximum portability. Again different varieties of the tee could be offered so that the golfer could choose the approximate tee, applicable for their needs. For example, the golfer chooses a different golf club from a variety of his golf clubs for his disposal. If the tee were made via a mold into one single entity, the approximately ⅛ inch flexible shaft would be an imaginary axis in relation to the vertical length of the practice ball rest and the anchor. If the golfer uses the tees with interchangeable parts, the anchor (FIG. 1A: 4) can vary in shape and size to accommodate soil conditions and preference of portability. Simply unscrewing one anchor (FIG. 1A; 4) (FIG. 2A: 5) and adding a different size anchor, or using the pointed end on the bottom of the tee shaft (FIG. 1A: 3) after the anchor is unscrewed can vary the tee anchor. For example the larger above tee anchor (FIG. 1A: 4) would be ideal for sandy soils and would allow for continuous practice with out tee replacement, when portability was not needed. For portability the latter tee anchor (FIG. 1A: 4) can be unscrewed from the bottom of the pointed tee shaft (FIG. 1A: 3). The bottom of the tee shaft is pointed and can easily be inserted into the ground. The flexible shaft is an important factor that increases the anchoring properties of the tee. The over all properties of the tee greatly eliminate the need for constant tee replacement. The flexible tee shaft (FIG. 1A: 3) neutralizes resistance factors to the point where it has less resistance factors than a conventional tee. This would pertain to all of the inventions parameters. Even when the tee is used with its maximum portability parameter tee replacement is decreased significantly over the conventional tee. Again a set of singly molded different varieties of this invention could accomplish the same principles as the invention presented with interchangeable parts. This would be considered in the scope of this invention. Also singly molded tees could be used with the interchangeable parts offered. This of course would depend on the different combinations of the parts of the invention that are chosen to be singly molded together.

The Manor and Process of Making and Using the Invetion (A) The invention can be made via molded pieces: colors may vary.

1) The tee shaft (FIG. 1A: 3) can be molded with an approximate ⅛-inch diameter or approximate ⅛-inch triangular, quadrilateral or polyangonal tee shaft thickness. The tee shaft length can vary from approximately the size of various convention tees to approximately 6½ inches, with the bottom of the tee shaft being preferably pointed; although this is not necessary. The tee shaft would be made of a durable, flexible type plastic similar to weed trimmer line (remember different parts of the invention can be incorporated with the tee shaft via a single mold).

2) The "golf ball rest": (FIG. 1A: 2) (FIG. 4A: 6)

a) The "golf ball rest"(FIG. 4A: 6) and tee shaft can be molded into one piece.

b) The "combination golf ball rest/conventional tee head"(FIG. 1A: 2) can be molded separately. In this case the shape and size of the "combination golf ball rest/conventional tee head" would simulate the shape and size of a Conventional tee head. The "combination golf ball rest/conventional tee head" would have a threaded Cylindrical bore through its enterer vertical axis that would accomadate the ⅛-inch diameter flexible shaft. By screwing the "combination golf ball rest/conventional tee head" up and down the upper tip of the tee shaft the "combination golf ball rest/conventional tee head" would be used to convert the tee from its insertion tip parameter to its conventional golf tee parameter. The upper portion of tee shaft can be threaded to accomadate the "combination golf ball rest/conventional tee head" although it is not necessary given the hardness characteristics of the tee shaft. A variety of different mechanical ways of changing the tee from the insertion tip parameter (which is a unique original parameter of the invention) to the conventional tip parameter is possible and is considered to be within the scope of this invention.

3) The golf tee anchor (FIG. 1A: 4) (FIG. 2A: 5)for maximum stability as previously mentioned, can be Molded via inside threads to accomadate the bottom of the tee Shaft (FIG. 1A: 3). The anchor length (FIG. 1A: 4) from the bottom of the tee upwards is Approximately one inch. The diameter at the top of the anchor is approximately one inch. The diameter at the bottom of the anchor (FIG. 1A: 4) is approximately ½-inch. The anchor (FIG. 1A: 4) is conically shaped and uniformly encircles the approximately ⅛ inch flexible shaft (FIG. 1A: 3), which is the vertical axis of the tee. The bottom of the tee shaft (FIG. 1A: 3) is preferably pointed and is screwed into the anchor. The lower portion of tee shaft can be threaded to accomadate the golf tee anchor although it is not necessary.

The molded anchor (FIG. 1A: 4) would be similar to an electrical wire cap. Anchor size, shape, and solid volume characteristics, can be varied to accomadate the physical characteristics of the soil or golf lie conditions. Again if interchangeable parts are used the anchor (FIG. 1A: 4) can be unscrewed from the bottom of the tee shaft (FIG. 1A3: 3) and the pointed tee shaft (FIG. 1A: 3) end can be used as the tee anchor, as is the case, when a conventional tee is used. This would allow for maximum tee Portability. The bottom of the tee shaft may be threaded to accomadate the threaded Anchor. Although it is not necessary given the hardness characteristics of the tee shaft. If the anchor (FIG. 1A: 4) was made via interchangeable parts it would contain an inside threaded cylindrical bore to accommodate the tee shaft which would be screwed onto the anchor. A variety of mechanical ways exist that would permit the anchor to be attached and detached from the tee shaft of which would be considered to be within the scope of this invention.

4) A singly molded screw on/off conventional tee head (FIG. 4A: 7) with a partial cylindrical bore and inside threads could be screwed on to the top of the tee shaft thus simulating a conventional tee. This would be used with the singly molded golf tee shaft/rest (FIG. 4A: 6) in section (A) (2) of page (12) or with the fixed "golf ball rest"(FIG. 4A: 6), described in section (B) (2) pages 15 below. In each of latter cases the golf ball rest (FIG. 4A: 6) is fixed in an insertion parameter position on the tee shaft. The golfer would screw the tee head (FIG. 4A: 7) on for conventional use. The golfer would unscrew the tee head (FIG. 4A: 7) so that he/she could use the insertion tip parameter of the tee. The insertion tip of the tee could have threads to accommodate the screw on/off conventional tee head but it is not necessary given the hardness characteristics of the tee shaft. Different mechanical ways of allowing a conventional tee head to be affixed to or taken off of the tee tip are possible and would be considered to be in the scope of this convention.

(B) The invention can also be made as follows: colors may vary.

1) The golf tee shaft (FIG. 1A: 3)would be made of weed trimmer line with an approximate ⅛-inch thickness. The trimmer line would be cut to the desired length of approximately 6½ to 2½ inches. Then use a utility knife to add a pointed tip to the bottom of the tee shaft. The pointed bottom tip is preferred but not necessary.

2) To make the golf ball rest (FIG. 4A: 6) use an adhesive, durable, waterproof type tape; wrap the shaft at the appropriate height on the tee shaft, to allow for an approximate ¼-inch insertion tip. The diameter of the tee shaft should be increased approximately to 7/16 to ½ inch thickness. The length of the "golf ball rest" should be about ½-inch. The shaft area that is being wrapped with tape can be roughened to increase the permanent status of the "golf ball rest". Wrap the tape on the tee shaft so that the top of the "golf ball rest" is conically shaped that is with the vertex of the cone pointing upwards. This is preferred but not necessary.

The "golf ball rest"(FIG. 4A: 6) can also be made by applying glue using a glue gun or a resilient type of epoxy glue to the tee shaft at the approximate "golf ball rest" height on the upper portion of the tee shaft, which is about ¼-inch down from the top of the golf tee shaft. Roughening the shaft via sand paper or a file would be helpful in securing the glues hardened position on The tee shaft. This bulge of glue or epoxy cement will dry into a golf ball rest. The golf ball rest (FIG. 4A: 6) could also be made using a smaller electrical screw Cap, that would accomadate the upper shaft of the tee. The screw Cap would have its closed tip opened as to allow the tee shaft to pass through the screw cap. This can be accomplished via sawing, cutting or drilling the closed end of the screw cap. This would allow the electrical screw cap to be screwed and glued or just screwed onto the tee shaft at the appropriate height to make the golf ball rest. The screw cap can be screwed onto the upper tee shaft via the original opened end or the modified opened end. If the electrical screw cap were to be screwed onto the upper tip of the tee shaft and not glued into a permanent golf ball rest position. It could be used for the insertion tip parameter or the conventional golf tee parameter of the tee. This is because it could be screwed up and down on upper tip of the tee shaft. Threading on the upper tee shaft to accomadate the screw cap is possible but not necessary due to the hardness characteristics of the tee shaft. If the electrical screw cap is screwed on the upper tip of the tee shaft and glued into a permanent position approximately ¼ inch down from the upper tip of the golf tee shaft. It would than become a fixed golf ball rest (FIG. 4A: 6) and could be used with the singly molded screw on/off tee head. (FIG. 4A: 7)

3) The golf ball rest can also be added to the tee shaft via the singly molded tee head, (FIG. 1A: 2) with a full length cylindrical bore, that has inside threads (previously noted as the "combination golf ball rest/tee head" Thus allowing the conventionally shaped tee head to be screwed up and down the tee shaft. The tee head can act as a golf ball rest or a conventional tee head at the golfers preference.

4) If the golf ball rest (FIG. 4A: 6) is made with the adhesive type tape, the singly molded screw on/screw off conventional tee head (FIG. 4A: 7) with a partial cylindrical bore can be screwed on to the insertion tip of the golf tee. Thus the tee head and shaft would simulate a conventional golf tee. The tee head (FIG. 4A: 7) could be unscrewed from the insertion tip in order to use the insertion tip parameter of the tee.

5) Then add the anchor (FIG. 1A: 4) via an electrical screw type wire cap, used in electrical wiring frequently. Note the anchor (FIG. 1A: 4) is screwed onto the bottom pointed end of the tee shaft FIG. 1A: 3). Thus the golfer can unscrew the larger anchor (FIG. 1A: 4)and use the pointed bottom end of the tee (FIG. 1A: 3) as an anchor. Thus adding more portability to the tee, which would be at the golfer's preference. Different size electrical screw caps can be used to accomadate portability and stability versus soil conditions and golfer preferences.

Both of the above manners and processes of making the invention (section A & B) can be combined in different combinations to make the invention.

The scope of one parameter of this invention allows for a stable teeing up of a featherweight wiffle type, practice golf ball, or a modified regular weight golf ball into which insertion holes were incorporated. The stability and ease of teeing up the practice golf ball would be much greater than the convention type golf tee. Even in sandy soil, windy, rainy, sunny, darkened or uneven ground conditions, the advantage of teeing up would be much greater for the golfer.

The advantage exists because of the insertion tip on the golf tee. The insertion tip allows the wiffle practice golf ball to be set on the tee feathered in grass. This would be hard to accomplish with the head of a conventional tee because of the small mass of the hallowed practice golf ball. In reference to the solid type modified golf ball a consistent lie, simulating actual tee off conditions, with the golf ball being feathered in grass would be a great advantage on golf driving ranges. Mat and mat tees used on a regular basis on the driving ranges do not simulate the grass and conventional tee combination used in game situations. Conventional tees used in practice on and off the driving range have the disadvantage of continuous replacement. The flexible and anchoring properties scope of the invention would allow for continuous practice without repositioning the tee. The insertion dimension differentials between the approximate (¼, ⅜) inch hole in the practice golf ball and the approximate ⅛ inch diameter flexible golf tee shaft, along with the anchoring properties of the tee, will allow for a resistance free take off in the flight of the practice golf ball. This will greatly imitate that of a conventional hit regulation golf ball. The practice golf ball will hook, slice, or travel in a straight trajectory. The golfer who is practicing will be able to adjust the power and position of his or her swing accomplishing the goal of driving the practice golf ball in a straight trajectory, with respect to the horizontal and vertical. These adjustments will carry over to the actual game situation. The tee becomes versatile by adding an optional screw on/off conventional tee head that is partially bored or a "combination golf ball rest/conventional tee head" that is fully bored. This gives the golfer the option to use the tee with non-holed golf balls. More versatility is added to the invention because of the screw on anchor that can also be removed or changed to add portability and stability at the golfers discretion.

How to Use the Invention

To use the insertion tip parameter of the golf tee in your own back yard, allow about 100 feet for driving the waffled type practice golf balls. The practice tee should be adjusted to the golfers desired height. I would recommend that the tee height would simulate actual tee off conditions. It may be necessary to punch a hole in the soil depending on the soil conditions in order to place the tee anchor into the soil especially if a large anchor is used. Remember the large tee anchor bottom is preferably flat (all thought this is not absolutely necessary) to help ensure the stability of the entire tee apparatus. Once the tee is placed at the desired height, tamp the soil around the tee with your foot, and the tee will be ready for continuous practice. Use the holes in the practice ball as the point of insertion onto the tee. The hardness characteristic of the impact area on the tee, are such that it will not damage the golf club. When using the tee to drive modified regulation type golf balls, driving range type areas are needed for safety reasons. Remember if using the insertion tip, hole/holes must be incorporated into golf balls with out insertion holes.

To use the tee on a golf course the insertion tip and plastic waffled type golf balls make a good combination for warming up prior to teeing off especially if the larger anchor is unscrewed and the pointed shaft is used as the tee anchor. This addresses the portability, space and safety needs of warming up on a golf course prior to teeing off.

To use the tee in actual game situations the larger anchor can be removed and the screw on tee head or (screw on golf ball rest/conventional tee combination apparatus) can be added to the tee.

To use the tee on a golf driving range add the screw on tee head or (screw on golf ball rest/conventional tee combination apparatus) and anchor according to the soil conditions. The tee will stay anchored in the ground for continuous practice with a perfect grass lie. To use the invention in an actual game situation with the mutual agreement of other players as discussed in the section "The Brief Description of Invention". Referring to Note: The amateur golfer can correct his hook or slice using the insertion tip parameter in conjunction with a regulation golf ball in which a hole is incorporated.

The use of the golf tee mats typically used on the driving ranges does not give realistic tee off conditions. If the golfer chooses to use a conventional tee off the grass at the driving range constant tee replacement becomes very tedious and distracting and is very unproductive in respect to the practice session. The use of this invention eliminates and improves these unproductive situations.

The invention is subject to dimension and shape changes with respect to the insertion tip, tee shaft, golf ball rest and anchor. It is also possible that different materials may be used to recreate the invention. The scope of the invention idea is that the invention brings forth a new way to tee up practice golf balls, using the idea of an insertion tip method. The new idea of an insertion tip combined with anchoring, flexibility, durability, hardness, and color characteristics of the tee make it very versatile, portable, or non portable (if anchored permanently). The tee with the insertion tip parameter could also conceivably be used to play the game of golf if a mutual agreement between players existed, such that a modified regulation golf ball (insertion hole/holes in the golf ball) would be allowed in the game. This would apply especially at the non-professional level of golf and would be great for the beginners golf game, in that the insertion tip parameter gives the golf ball a straighter trajectory due to a left and right spin resistance on the insertion tip via the weight of a regulation type golf ball on the insertion tip of the tee and the bored insertion hole into the solid type golf ball. The screw on/off conventional tee head or the "combination golf ball rest/conventional tee head" parameters of the tee insures that the tee complies with conventional tee up regulations, and allows the tee to be used in a conventional manner. Constant repositioning of the tee in the ground and constant tee replacement is eliminated via the characteristics of the invention. The screw on/screw off conventional tee head, "combination golf ball rest/conventional tee head" and screw on anchor broadens the scope of the invention and adds complete versatility to the invention with respect to the game of golf. Different combinations of the tee could be made and used individually with out using all the parts of the invention. This would be considered to be in the scope of the invention. For example singly molded (tees with anchors) offered in different sizes pertaining to the tee shaft length and anchor sizes can be made by a single mold. These variations could include a fixed or molded golf ball rest that would be compatible with the screw on tee head previously described. These variations without the fixed or molded golf ball rest could also accomadate the "combination golf ball rest/conventional tee head" attachment or the screw on/screw off tee head attachment. It is also possible to make different size tee shafts that contain different aspects of the invention into singly molded varieties that could be screwed on or off a variety of tee anchors. For example: 1) tee shaft/conventional tee head single mold. 2) tee shaft/golf ball rest single mold.

These and any other combinations would be considered to be in the scope of the invention. Mechanical changes on how to add or take off parts of the invention or to change from one parameter of the invention to another are possible. These changes would still be considered within the scope of the invention. Different parameters of the invention can be incorporated in individual tees. So that sets of tees would incorporate the parameters of the invention, or a single tee would incorporate one or more of the parameters of the invention. This would be considered in the scope of the invention.

We claim:

1. A practice/playing golf tee for providing continuous practice without replacing, removing or resetting the tee, said tee comprising:

a. a flexible, durable insertion tip for insertion into a practice golf ball or regulation golf ball having an insertion hole;

b. a flexible, durable tee head having a cylindrical bore with threads therein and providing a resting place for the outside surface of the golf ball;

c. a flexible, durable tee shaft extending from the golf ball rest, the tee shaft having threaded ends with the end opposite the golf ball rest also being pointed; the tee head being adjustable along the length of the tee shaft via the threads in order to regulate the depth that the insertion tip is inserted into the golf ball;

d. a tee anchor for retaining the tee in the ground, the tee anchor having threads for threadingly engaging the pointed end of the tee shaft.

2. A practice/playing golf tee for providing continuous practice without replacing, removing or resetting the tee, said tee comprising:

a. a flexible, durable insertion tip for insertion into a practice golf ball or regulation golf ball having an insertion hole.

b. a flexible, durable tee head having a cylindrical bore with threads therein and providing a resting place for the outside surface of the golf ball;

c. a flexible, durable tee shaft extending from the golf ball rest, the tee shaft having threaded ends with the end opposite the golf ball rest also being pointed; the tee head being adjustable along the length of the tee shaft via the threads in order to regulate the depth that the insertion tip is inserted into the golf ball;

d. a tee anchor for retaining the tee in the ground, the tee anchor being integrally molded to the end of the tee shalt.

* * * * *